US010022991B2

(12) United States Patent
Sakano

(10) Patent No.: US 10,022,991 B2
(45) Date of Patent: Jul. 17, 2018

(54) TAPE CARTRIDGE

(71) Applicant: Seiko Epson Corporation, Tokyo (JP)

(72) Inventor: Hideki Sakano, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/128,473

(22) PCT Filed: Mar. 19, 2015

(86) PCT No.: PCT/JP2015/058316
§ 371 (c)(1),
(2) Date: Sep. 23, 2016

(87) PCT Pub. No.: WO2015/146796
PCT Pub. Date: Oct. 1, 2015

(65) Prior Publication Data

US 2017/0106680 A1 Apr. 20, 2017

(30) Foreign Application Priority Data

Mar. 24, 2014 (JP) ..... 2014-060915

(51) Int. Cl.
*B41J 15/04* (2006.01)
*B41J 3/407* (2006.01)

(52) U.S. Cl.
CPC ..... *B41J 15/044* (2013.01); *B41J 3/4075* (2013.01)

(58) Field of Classification Search
CPC ..... B41J 15/044; B41J 3/4075; B41J 13/00; B41J 13/0009; B41J 15/00; B41J 15/04; B41J 15/046
See application file for complete search history.

(56) References Cited

U.S. PATENT DOCUMENTS

| | | | |
|---|---|---|---|
| 4,620,199 | A | 10/1986 | Tatsumi et al. |
| 5,253,334 | A | 10/1993 | Kimura et al. |
| 5,666,251 | A | 9/1997 | Fujii et al. |
| 8,382,389 | B2 | 2/2013 | Yamaguchi et al. |
| 8,562,228 | B2 | 10/2013 | Yamaguchi et al. |
| 8,651,756 | B2 | 2/2014 | Yamaguchi et al. |

(Continued)

FOREIGN PATENT DOCUMENTS

| | | | |
|---|---|---|---|
| CN | 101758676 | A | 6/2010 |
| CN | 102481794 | A | 5/2012 |

(Continued)

OTHER PUBLICATIONS

Search Report received in international Application No. PCT/JP2015/058316, dated Jun. 9, 2015.

*Primary Examiner* — Kristal Feggins
(74) *Attorney, Agent, or Firm* — ALG Intellectual Property, LLC

(57) ABSTRACT

A tape cartridge to be mounted in a tape printing apparatus including plural push switches which project from a mounting circumferential wall includes plural detection target portions that is provided on an outer circumferential surface of the tape cartridge and to be opposed to the plural respective push switches when the cartridge is mounted in or unmounted from a cartridge mounting unit of the tape printing apparatus. Each of the plural detection target portions has a slide portion that extends in the mounting/unmounting direction and operates the associated push switch while sliding when the cartridge is mounted in the cartridge mounting unit.

10 Claims, 10 Drawing Sheets

(56) References Cited

U.S. PATENT DOCUMENTS

| | | | |
|---|---|---|---|
| 8,770,877 | B2 | 7/2014 | Yamaguchi et al. |
| 2010/0166475 | A1 | 7/2010 | Yamaguchi et al. |
| 2010/0166477 | A1 | 7/2010 | Yamaguchi et al. |
| 2010/0166478 | A1 | 7/2010 | Yamaguchi et al. |
| 2010/0166479 | A1 | 7/2010 | Yamaguchi et al. |
| 2010/0166480 | A1 | 7/2010 | Yamaguchi et al. |
| 2010/0247205 | A1 | 9/2010 | Yamaguchi et al. |
| 2010/0247206 | A1 | 9/2010 | Yamaguchi et al. |
| 2010/0254742 | A1 | 10/2010 | Yamaguchi et al. |
| 2011/0103871 | A1 | 5/2011 | Van Coppenolle et al. |
| 2012/0080550 | A1 | 4/2012 | Yamaguchi et al. |
| 2012/0175454 | A1 | 7/2012 | Noda |
| 2013/0142560 | A1 | 6/2013 | Yamaguchi et al. |
| 2013/0315644 | A1 | 11/2013 | Yamaguchi et al. |
| 2014/0112694 | A1 | 4/2014 | Yamaguchi et al. |
| 2014/0175204 | A1 | 6/2014 | Yamaguchi et al. |
| 2014/0199108 | A1 | 7/2014 | Yamaguchi et al. |
| 2014/0204170 | A1 | 7/2014 | Yamaguchi et al. |
| 2014/0205341 | A1 | 7/2014 | Yamaguchi et al. |
| 2014/0205342 | A1 | 7/2014 | Yamaguchi et al. |
| 2014/0205343 | A1 | 7/2014 | Yamaguchi et al. |
| 2014/0205344 | A1 | 7/2014 | Yamaguchi et al. |
| 2014/0205345 | A1 | 7/2014 | Yamaguchi et al. |
| 2014/0205346 | A1 | 7/2014 | Yamaguchi et al. |
| 2014/0205347 | A1 | 7/2014 | Yamaguchi et al. |
| 2014/0205348 | A1 | 7/2014 | Yamaguchi et al. |
| 2014/0205349 | A1 | 7/2014 | Yamaguchi et al. |
| 2014/0205350 | A1 | 7/2014 | Yamaguchi et al. |
| 2014/0205352 | A1 | 7/2014 | Yamaguchi et al. |
| 2014/0205353 | A1 | 7/2014 | Yamaguchi et al. |
| 2014/0320581 | A1 | 10/2014 | Yamaguchi et al. |
| 2014/0340463 | A1 | 11/2014 | Van Coppenolle et al. |
| 2015/0174932 | A1 | 6/2015 | Yamaguchi et al. |
| 2015/0298476 | A1 | 10/2015 | Yamaguchi et al. |
| 2015/0306892 | A1 | 10/2015 | Noda |
| 2016/0250873 | A1 | 9/2016 | Van Coppenolle et al. |
| 2017/0008318 | A1 | 1/2017 | Yamaguchi et al. |

FOREIGN PATENT DOCUMENTS

| | | | |
|---|---|---|---|
| JP | S60-053571 | | 4/1985 |
| JP | H05-018853 | A | 3/1993 |
| JP | H06-349237 | A | 12/1994 |
| JP | H10-157235 | | 6/1998 |
| JP | 2007-223292 | | 9/2007 |
| JP | 2010-076167 | A | 4/2010 |
| JP | 2010-149434 | | 7/2010 |
| JP | 2010-149437 | A | 7/2010 |
| JP | 2011-520645 | T | 7/2011 |
| JP | 2012-061862 | A | 3/2012 |
| JP | 2013-141749 | | 7/2013 |
| WO | WO-2013-039139 | A1 | 3/2013 |

FIG. 10A
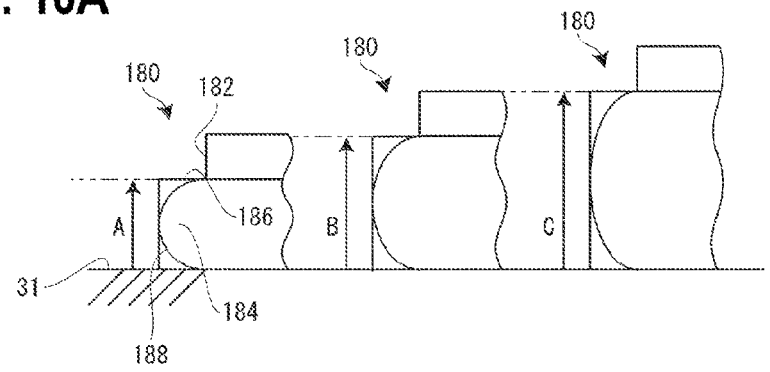
FIG. 10B
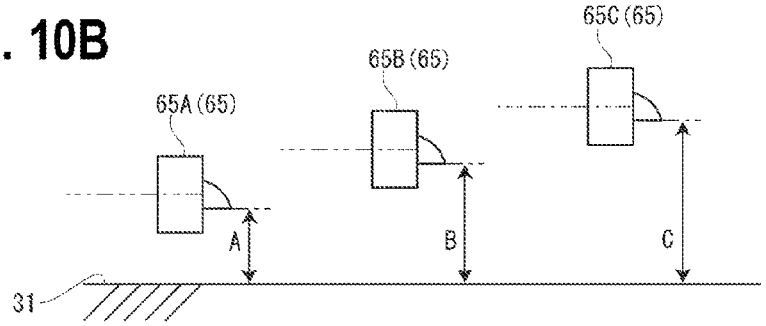
FIG. 10C
| TC / SW | 12 in/in TAPE CARTRIDGE | 18 in/in TAPE CARTRIDGE | 24 in/in TAPE CARTRIDGE |
|---|---|---|---|
| 12 in/in SWITCH | ON | OFF | OFF |
| 18 in/in SWITCH | ON | ON | OFF |
| 24 in/in SWITCH | ON | ON | ON |

TAPE CARTRIDGE

CROSS-REFERENCE TO RELATED APPLICATIONS

This application is the U.S. National Phase under 35 U.S.C. § 371 of International Application No. PCT/JP2015/058316 filed on Mar. 19, 2015, which in turn claims the benefit of Japanese Application No. 2014-060915 filed on Mar. 24, 2014, the disclosures of which are expressly incorporated by reference herein.

TECHNICAL FIELD

The present invention relates to a tape cartridge to be mounted detachably in a tape printing apparatus whose cartridge mounting unit is provided with push switches for detecting the thickness of the tape cartridge.

BACKGROUND ART

Among known tape cartridges of the above type is a tape cassette having a recess-like space that conforms to a sensor support portion provided in a cassette mounting unit of a printed label producing apparatus (refer to JP-2013-141749).

A printing mechanism and a conveying mechanism for printing on a tape portion that is paid out from a tape cassette are disposed in the cassette mounting unit of the printed label producing apparatus. A rectangular-prism-shaped sensor support portion incorporating plural sensors for detecting attribute information of a tape (film tape) is erected in the cassette mounting unit. A front side surface of the sensor support portion is provided with four reflection sensors arranged in the longitudinal direction and its right side surface is also provided with four reflection sensors arranged in the longitudinal direction.

On the other hand, a tape cassette is equipped with an adhesive tape spool on which a double-sided adhesive tape is wound, a film tape spool around which a print tape (print tape) is wound, a ribbon spool around which an ink ribbon is wound, a ribbon take-up spool for taking up the ink ribbon, a tape drive roller, and a cassette case that houses them. A recess-like space that conforms to the sensor support portion is formed in the space between the double-sided adhesive tape and the film tape. Circumferential walls that define the recess-like space is provided with a total of eight black-painted detection target portions so as to correspond to the above respective reflection sensors.

SUMMARY

In such a conventional tape cassette, it is unavoidable that the detection target portions be compact because the recess-like space is formed in the narrow space between the double-sided adhesive tape and the film tape. As a result, the amount of information of the attribute information (information to be detected) of the film tape may be restricted or the detection may be rendered unstable.

On the other hand, if detection target portions were formed on, for example, the bottom surface of the tape cassette (tape cartridge) to secure a wide space, erroneous detection might occur due to dust or the like in the case where the detection elements on the cassette mounting unit side are optical sensors or the like. Where the detection elements on the cassette mounting unit side are micro-switches or the like, force acts on the tape cassette in such a direction as to lift it up and hence it is necessary to provide a structure for suppressing that motion.

An object of the present invention is to provide a tape cartridge that enables reliable thickness detection without requiring a large space for detection target portions.

Means for Solving the Problems

The tape cartridge according to the invention is a tape cartridge to be mounted in a tape printing apparatus provided with a cartridge mounting unit which has a mounting base portion and a mounting circumferential wall surrounding the mounting base portion and in which plural kinds of tape cartridges different from each other in the thickness in a mounting/unmounting direction can be mounted; and plural push switches which project from the mounting circumferential wall at such positions that distances from the mounting base portion vary from each other according to thicknesses of the plural kinds of tape cartridges, characterized in that an outer circumferential surface of the tape cartridge has plural detection target portions to be opposed to the plural respective push switches when the cartridge is mounted in or unmounted from the cartridge mounting unit; and that each of the plural detection target portions has a slide portion which extends in the mounting/unmounting direction and operates the associated push switch while sliding when the cartridge is mounted in the cartridge mounting unit.

According to this configuration, since the outer circumferential surface of the tape cartridge is formed with the plural detection target portions which correspond to the plural respective push switches of the tape printing apparatus, the detection target portions do not require a large space, whereby size increase of the tape cartridge can be suppressed. Furthermore, since the spring force of each push switch acts in a direction that crosses the mounting direction, it does not serve as force of lifting up the tape cartridge from the mounting base portion. Still further, since each push switch is operated while sliding on the associated slide portion extending in the mounting/unmounting direction, the push switches for detection of the thickness of the tape cartridge can be operated smoothly.

In the above configuration, it is preferable that the slide portion include a mounting guide slant surface which guides the associated push switch when the tape cartridge is mounted in the cartridge mounting unit.

It is preferable that the slide portion include an unmounting guide slant surface which guides the associated push switch when the tape cartridge is unmounted from the cartridge mounting unit.

According to these configurations, each push switch is rendered into a first operation state or a second operation state smoothly. Thus, the push switches do not lower the smoothness of mounting and unmounting of the tape cartridge.

It is preferable that the slide portion be recessed in the outer circumference surface.

According to this configuration, a stem of each push switch can easily be brought into contact with the associated slide portion.

On the other hand, it is preferable that the tape cartridge further have a cartridge case having a top case and a bottom case; that the plural kinds of tape cartridges have the respective top cases which are located on the source side in the mounting direction and are the same in thickness and the respective bottom cases which are located on the destination side in the mounting direction and are different from each other in thickness; and that at least one of the plural push switches not be operated in a state that the tape cartridge is mounted in the cartridge mounting unit, and a recess to which the at least one push switch is to be opposed be formed in the top case.

According to this configuration, detection target portions (fixed positions as indices indicating a thickness) can be formed easily in each of plural tape cartridges that are different from each other in thickness. Furthermore, the plural kinds of tape cartridges can employ a common top case, whereby cost increase due to the formation of the detection target portions can be suppressed.

In the above configuration, it is preferable that the top case and the bottom case be formed so as to be disassembled from each other in the mounting direction by a disassembling jig; and that an end surface of a recess which extends from a source-side end in the mounting direction to a fixed position as an index indicating the thickness be a butting surface against which the disassembling jig is to butt.

According to this configuration, a detection target portion can be formed using a portion including the butting surface for the disassembling jig. This is also effective in suppressing cost increase due to the formation of the detection target portions It is preferable that the plural detection target portions correspond to the plural respective push switches that are disposed on the mounting circumferential wall so as to be distributed in the circumferential direction, and be disposed on the outer circumferential surface of the cartridge case so as to be distributed in the circumferential direction.

According to this configuration, the plural push switches can be arranged without causing any space-related problems. Furthermore, the spring forces of the plural push switches can function as forces for holding the cartridge case by pushing it, whereby positional deviation of the cartridge case can be suppressed.

In the above configuration, it is preferable that one of the detection target portions that corresponds to a push switch that is operated most frequently for the plural kinds of tape cartridges to be mounted be located at a position that is closest to a platen provided in the tape cartridge.

According to this configuration, when a thick tape cartridge is mounted, positional deviation of the cartridge case can be suppressed by the spring forces of the plural push switches.

It is preferable that the mounting guide slant surface form an acute angle with the mounting direction of the mounting/unmounting direction.

According to this configuration, an operation of mounting the tape cartridge can be performed smoothly.

Likewise, it is preferable that the unmounting guide slant surface form an acute angle with the unmounting direction of the mounting/unmounting direction.

According to this configuration, an operation of unmounting the tape cartridge can be performed smoothly.

BRIEF DESCRIPTION OF THE DRAWINGS

FIGS. 10A-10C are explanatory diagrams showing a method for detecting the thickness of the tape cartridge by means of plural thickness detection switches.

DESCRIPTION OF EXEMPLARY EMBODIMENTS

A tape cartridge according to an embodiment of the present invention will be hereinafter described with reference to the accompanying drawings, together with a tape printing apparatus to be mounted with it. The tape printing apparatus serves to produce a label (tape piece) by performing printing while causing parts of a print tape and an ink ribbon to be paid out from the tape cartridge mounted therein and then cutting away a printed portion of the print tape.

[Outline of Tape Printing Apparatus]

Figure 1:
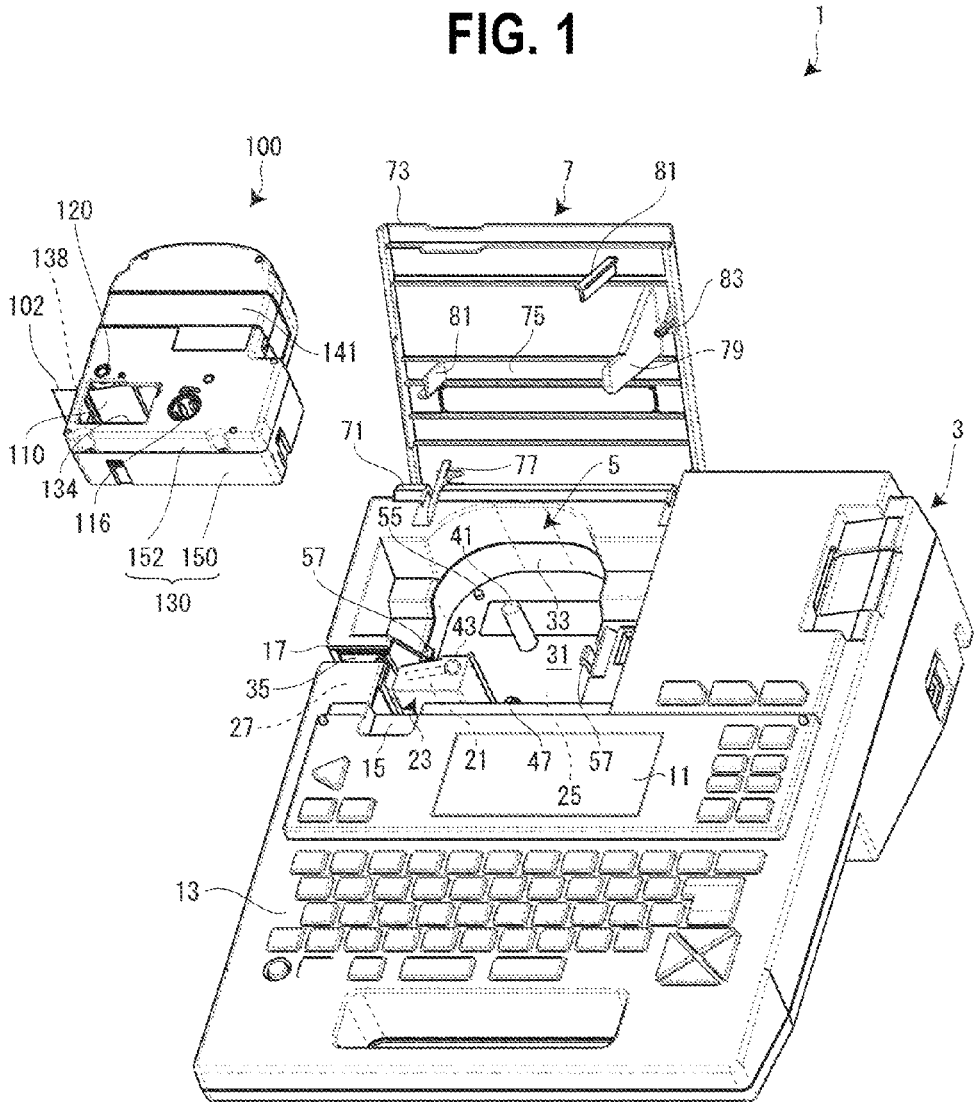
FIG. 1 is a perspective view showing an appearance of a tape printing apparatus according to an embodiment being in a lid-open state.

FIG. 1 is a perspective view showing an appearance of the tape printing apparatus and the tape cartridge to be mounted therein. As shown in this figure, the tape printing apparatus 1 is equipped with an apparatus case 3 as an outer case, a cartridge mounting unit 5 to be mounted with the tape cartridge 100 detachably, and an opening/closing lid 7 for opening and closing the cartridge mounting unit 5. The top surface of the apparatus case 3 is provided with the cartridge mounting unit 5 on the deep side, a display 11 at the center, and a keyboard 13 on the user side. A finger-hooking recess 15 is formed near the opening/closing lid 7. The opening/closing lid 7 is opened by lifting it up by hooking a finger on the recess 15. A side surface (left side surface) of the apparatus case 3 is formed with a vertically long tape outlet 17 through which part of a print tape 102 is to exit.

The tape printing apparatus 1 is also equipped with a print mechanism 23 having a print head 21 which is erected in the cartridge mounting unit 5, a tape feed mechanism 25 which is incorporated in a space formed on the back side of the cartridge mounting unit 5, and a tape cutting mechanism 27 which is incorporated near the tape outlet 17. A user inputs print information through the keyboard 13, checks the print information on the display 11, and starts printing by a key manipulation. Upon reception of a print instruction, the tape feed mechanism 25 is driven, whereby parts of the print tape 102 and an ink ribbon 110 run parallel with each other. Furthermore, ink is transferred from the ink ribbon 110 to the print tape 102 by means of heat that is applied to the ink ribbon 110 from the print mechanism 23. Part of the print tape 102 advances to exit through the tape outlet 17 as this printing feed proceeds. Upon completion of the printing, the tape cutting mechanism 27 is driven, whereby a printed portion of the print tape 102 is cut away.

[Outline of Tape Cartridge]

Figure 2A:
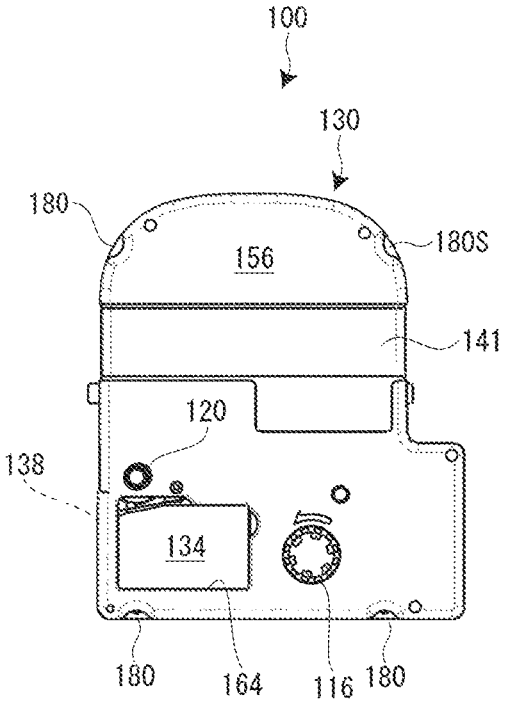
FIGS. 2A and 2B are a plan view and a side view, respectively, of a tape cartridge according to the embodiment.
Figure 2B:
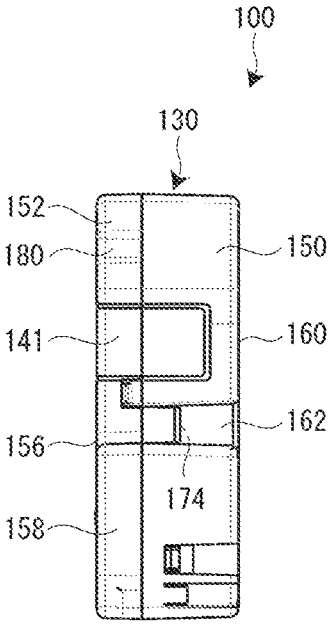
Figure 5A:
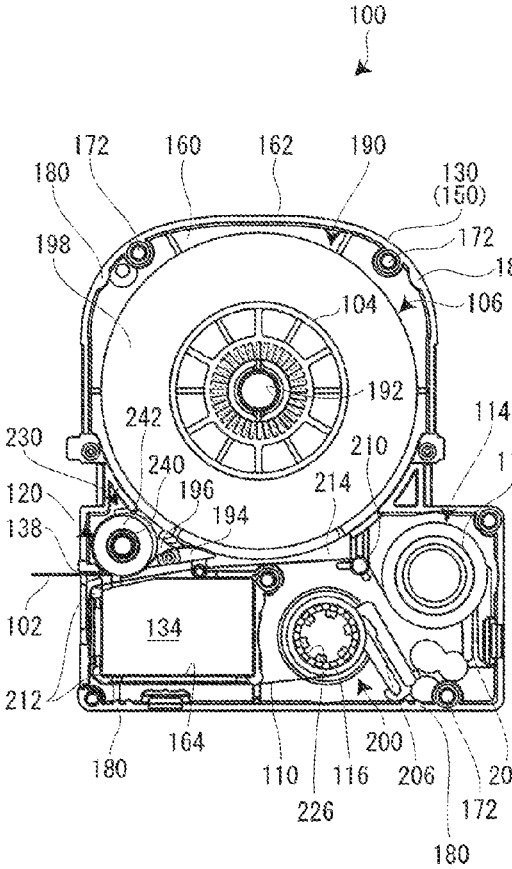
FIGS. 5A and 5B are a plan view of the tape cartridge from which a top case and a bottom case are removed and a bottom view of the top case, respectively.

As shown in FIGS. 2 and 5, the tape cartridge 100 is equipped with a tape roll 106 in which the print tape 102 is wound around a tape core 104. The tape cartridge 100 is also equipped with a ribbon roll 114 in which the ink ribbon 110 is wound around a pay-out core 112 and a take-up core 116 for taking up a used portion of the ink ribbon 110. The tape cartridge 100 is further equipped with a platen roller (platen) 120 to which the print head 21 is to be brought into contact and which serves to feed the print tape 102 and the ink ribbon 110. Still further, the tape cartridge 100 is equipped with a cartridge case 130 which houses the tape roll 106, the ribbon roll 114, the take-up core 116, and the platen roller 120. In this manner, the tape cartridge 100 according to the embodiment has what is called a shell structure in which the cartridge case 130 serves as an outer case.

The cartridge case 130 of the tape cartridge 100 is formed with an insertion opening 134 into which the print head 21 is to be inserted when the tape cartridge 100 is mounted in the tape printing apparatus 1. The cartridge case 130 of the tape cartridge 100 is also formed with a tape sending outlet 138 through which part of the print tape 102 is sent out. As described later in detail, the tape roll 106 is supported rotatably by a cylindrical core shaft 192 which projects in the inside space of the cartridge case 130.

When the platen roller 120 and the take-up core 116 are driven by the above-mentioned tape feed mechanism 25, part of the print tape 102 is paid out from the tape core 104 and part of the ink ribbon 110 is paid out from the pay-out core 112. The paid-out portions of the print tape 102 and the ink ribbon 110 run parallel with each other and are subjected to printing by the print head 21 when they run parallel with each other alongside the platen roller 120. The printed paid-out end portion (printed portion) of the print tape 102 is sent out from the tape sending outlet 138 to the tape outlet 17. On the other hand, the ink ribbon 110 goes around the circumferential wall of the insertion opening 134 and is taken up by the take-up core 116. Incidentally, plural (in the embodiment, three) kinds of tape cartridges 100 having different thicknesses are prepared to match respective tape widths of print tapes 102.

[Details of Tape Printing Apparatus]

Figure 3:
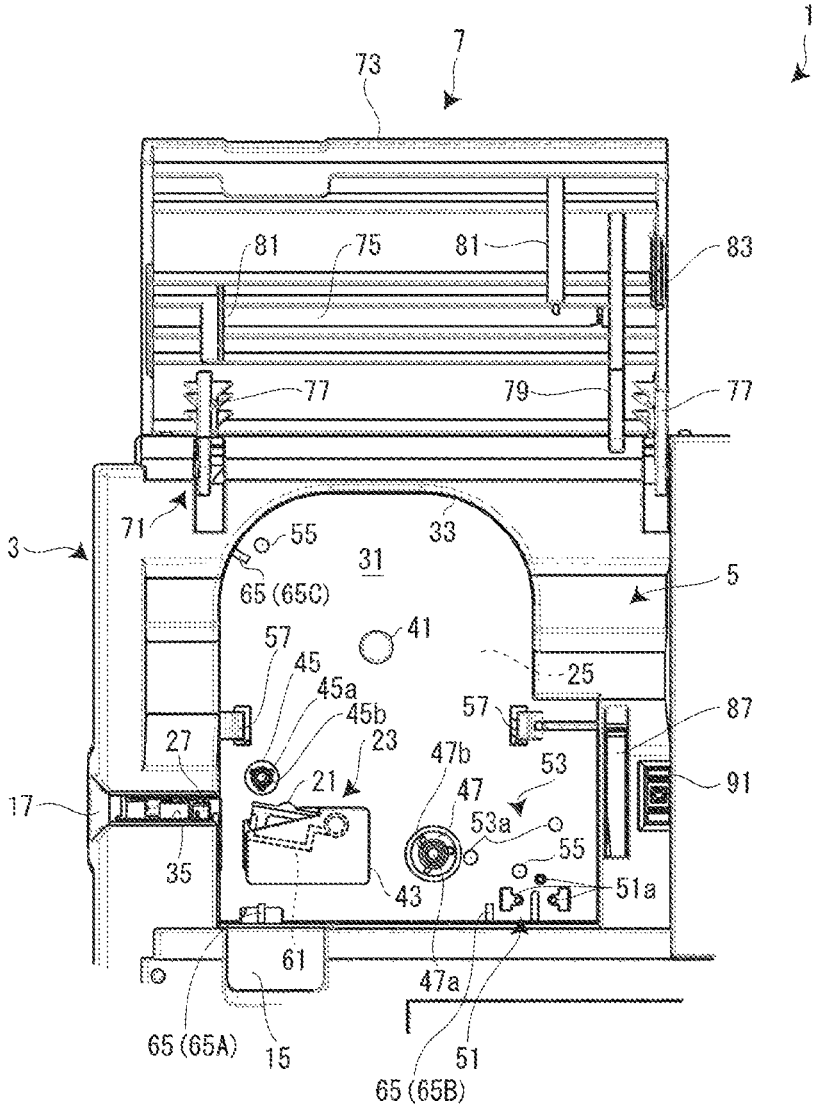
FIG. 3 is a plan view of a cartridge mounting unit.

As shown in FIGS. 1 to 3, the cartridge mounting unit 5 is shaped so as to be complementary to the plan shape of the tape cartridge 100 and is recessed so as to have such a depth as to house the thickest one of the plural kinds of mountable tape cartridges 100. A mounting base portion 31 as a bottom plate portion and a mounting circumferential wall 33 as a side plate portion of the cartridge mounting unit 5 are formed (molded) integrally with each other with resin or the like. A slit-like tape exit passage 35 is formed between the cartridge mounting unit 5 and the above-mentioned tape outlet 17, and the above-mentioned tape cutting mechanism 27 is incorporated adjacent to this portion.

A positioning projection 41 to be fitted with the core shaft 192 of the tape cartridge 100 to position the tape cartridge 100 when the tape cartridge 100 is mounted is erected from the mounting base portion 31 of the cartridge mounting unit 5. The print head 21 which is covered with a head cover 43, a platen drive shaft 45 for rotationally driving the platen roller 120, and a take-up drive shaft 47 for rotationally driving the take-up core 116 are also erected from the mounting base portion 31. The mounting base portion 31 is provided with, near the take-up drive shaft 47, a tape detection unit 51 for detecting the type (attribute information) of the print tape 102 and a core release unit 53 for canceling the rotation stop of the pay-out core 112 and the take-up core 116.

The mounting base portion 31 is also provided with a pair of small projections 55 at diagonal positions and a pair of latch pieces 57 for latching a middle portion of the tape cartridge 100 mounted. The above-mentioned tape feed mechanism 25 consisting of a motor, a gear train (neither of which are shown), etc. for rotating the platen drive shaft 45 and the take-up drive shaft 47 is incorporated in the space formed on the back side of the mounting base portion 31. The tape feed mechanism 25 rotates the platen drive shaft 45 and the take-up drive shaft 47 in a synchronized manner by dividing motive power by the gear train.

The print mechanism 23 has the print head 21 which is a thermal head and a head support frame 61 for supporting and swinging the print head 21. The print mechanism 23 also has a head release mechanism (not shown) for swinging the print head 21 between a printing position and an escape position via the head support frame 61 and the head cover 43 which covers the print head 21 (and the head support frame 61).

The head release mechanism, which operates in link with opening or closing of the above-mentioned opening/closing lid 7, moves (swings) the print head 21 to the printing position in link with a closing operation of the opening/closing lid 7. And the head release mechanism moves (swings) the print head 21 to the escape position in link with an opening operation of the opening/closing lid 7. At the printing position, the print head 21 comes into contact with the platen roller 120 of the tape cartridge 100 via the ink ribbon 110 and the print tape 102. At the escape position, the print head 21 is separated from the platen roller 120. This prevents the print tape 102 or the ink ribbon 110 from interfering with the print head 21 when the tape cartridge 100 is mounted or unmounted.

The print head 21 is provided with plural heating elements, which are arranged in a row in the axial direction of the platen roller 120. Printing is performed as the print tape 102 and the ink ribbon 110 are fed and the plural heating elements are driven selectively.

The head cover 43 is formed (molded) integrally with the above-mentioned mounting base portion 31 (cartridge mounting unit 5) so as to be approximately rectangular in a plan view. The head cover 43 projects a long distance from the mounting base portion 31 perpendicularly to it and allows the print head 21 to swing inside, and its outside circumference functions as a mounting guide for the tape cartridge 100.

The tape detection unit 51 consists of plural microswitches 51*a* which selectively engage with a detection receiving unit 178 (described later) of the tape cartridge 100 and thereby detects the type (tape color, material, etc.) of its print tape 102. The driving of the print head 21 and the tape feed mechanism 25 is controlled on the basis of a detection result. The tape width of the print tape 102 is detected by thickness detection switches 65 (described later) in the form of the thickness of the tape cartridge 100.

The core release unit 53 consists of two release pins 53*a* for the pay-out core 112 and the take-up core 116. As described later in detail, the cartridge case 130 is formed with rotation stop hooks 206 to be hooked on the pay-out core 112 and the take-up core 116, respectively (see FIG. 6). When the tape cartridge 100 is mounted, the release pins 53*a* engage with the respective rotation stop hooks 206, whereby the rotation stop of the pay-out core 112 and the take-up core 116 is canceled.

The platen drive shaft 45 has a fixed shaft 45*a* to be inserted into the platen roller 120 and a spline-shaped movable shaft 45*b* which is supported pivotally (rotatably) by a base portion of the fixed shaft 45*a*. Rotational power of the tape feed mechanism 25 is transmitted to the movable shaft 45*b* and then transmitted from the movable shaft 45*b* to the platen roller 120. Likewise, the take-up drive shaft 47 has a fixed shaft 47*a* and a spline-shaped movable shaft 47*b* which is supported pivotally (rotatably) by the fixed shaft 47*a*. Also in this case, rotational power of the tape feed mechanism 25 is transmitted to the movable shaft 47*b* and then transmitted from the movable shaft 47*b* to the take-up core 116.

When the tape cartridge 100 is mounted in the cartridge mounting unit 5, the core shaft 192 (tape core 104) engages with the positioning projection 41, the platen roller 120 engages with the platen drive shaft 45, and the take-up core 116 engages with the take-up drive shaft 47. When the opening/closing lid 7 is thereafter closed, the print head 21 is swung and comes into contact with the platen roller 120 with the print tape 102 and the ink ribbon 110 sandwiched between them, whereby the tape printing apparatus 1 is rendered in a print standby state.

On the other hand, as shown in FIG. 3, the mounting circumferential wall 33 of the cartridge mounting unit 5 is provided with plural thickness detection switches 65 for detecting the thickness of the tape cartridge 100 mounted. Prepared as the tape cartridges 100 according to the embodiment are, for example, a thin tape cartridge 100A incorporating a 12-mm-wide print tape 102, a medium-thickness tape cartridge 100B incorporating a 18-mm-wide print tape 102, and a thick tape cartridge 100C incorporating a 24-mm-wide print tape 102 (see FIG. 9). The width of the print tape 102 means a length of the print tape 102 in the direction that crosses the sending-out direction of the print tape 102.

Three thickness detection switches 65 are disposed on the mounting circumferential wall 33 so as to be distributed in the circumferential direction and to correspond to the three kinds of tape cartridges 100A, 100B, and 100C which are different from each other in thickness. Each thickness detection switch 65 is a push switch (microswitch), for example. Among the three thickness detection switches 65, the first detection switch 65A is disposed near the print head 21 (head cover 43), the second detection switch 65B is disposed near the above-mentioned tape detection unit 51, and the third detection switch 65C is disposed near one of the above-mentioned small projection 55.

As described later in detail, the three thickness detection switches 65A, 65B, and 65C are disposed in such a manner that their installation distances from the mounting base portion 31 vary so as to correspond to the thicknesses of the three kinds of tape cartridges 100A, 100B, and 100C, respectively. The three thickness detection switches 65A, 65B, and 65C are connected to a detection circuit (not shown), which detects the thickness of the tape cartridge 100 mounted on the basis of detection/non-detection (on/off) binary data of the respective detection switches 65.

Figure 4:
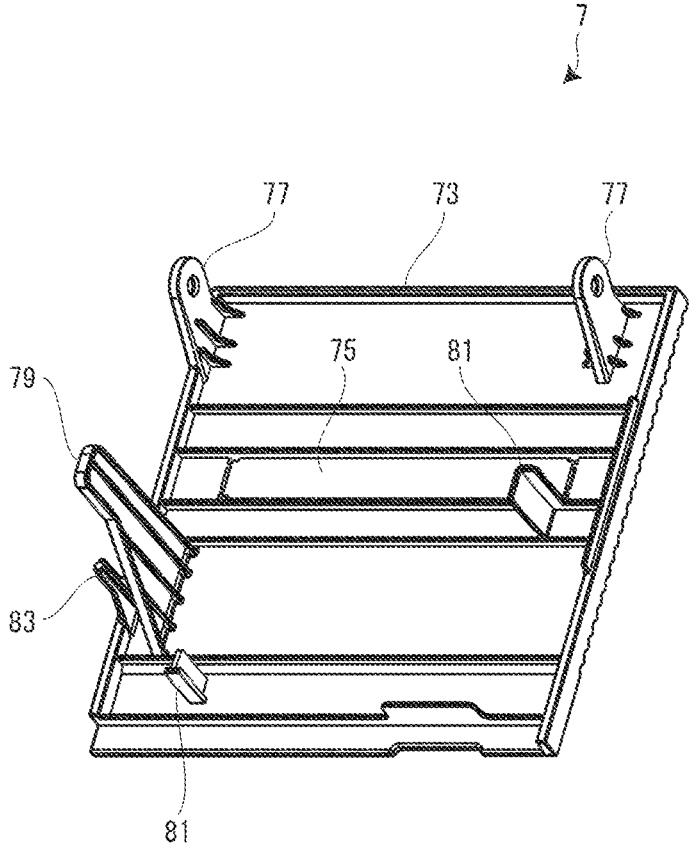
FIG. 4 is a perspective view, as viewed from the back surface side, of an opening/closing lid.

As shown in FIGS. 1 and 4, the opening/closing lid 7 is attached to the apparatus case 3 swingtably (i.e., openably and closably) via hinges 71 which are disposed on the deep side. The opening/closing lid 7 has an opening/closing lid body 73 and an observation window 75 formed at the center. The opening/closing lid 7 also has a pair of pivoted pieces 77 which project from the back surface of the opening/closing lid body 73 and are pivotally (swingably) supported by the respective hinge 71 and an operation lever 79 which projects from the back surface of the opening/closing lid body 73 and serves to swing the print head 21. The opening/closing lid 7 further has two pushing projections 81 which project from the back surface of the opening/closing lid body 73 and serve to push the tape cartridge 100 and a push-down projection 83 which projects from the back surface of the opening/closing lid body 73 and serves to operate (i.e., turn on) a built-in lid closure detection switch (not shown).

The observation window 75 is long in the horizontal direction and is formed separately from the opening/closing lid body 73 with a transparent resin (transparent to visible light). The tape cartridge 100 mounted in the cartridge mounting unit 5 can be seen (i.e., the type and a tape residual amount of the print tape 102 can be recognized) through the observation window 75. The pair of pivoted pieces 77, the operation lever 79, the two pushing projections 81, the push-down projection 83, and the opening/closing lid body 73 are formed (molded) integrally with each other with resin.

The operation lever 79, which projects from the back surface of the opening/closing lid body 73, is inserted into a slit opening 87 which is formed beside the cartridge mounting unit 5 when the opening/closing lid 7 is closed. When inserted into the slit opening 87, the operation lever 79 operates the above-mentioned head release mechanism and thereby swings the print head 21 toward the platen roller 120. Likewise, when the opening/closing lid 7 is closed, the push-down projection 83 is inserted into a rectangular opening 91 formed adjacent to the slit opening 87 and thereby operates (i.e., turns on) the lid closure detection switch.

One pushing projection 81 is formed at a position that corresponds to a position near the platen roller 120 of the tape cartridge 100. The other pushing projection 81 is formed at such a position as to be located right over the above-mentioned tape detection unit 51. When the opening/closing lid 7 is closed, the two pushing projections 81 push the tape cartridge 100 so that it is placed on the mounting base portion 31 of the cartridge mounting unit 5 and prevents a rise of the tape cartridge 100.

[Details of Tape Cartridge]

Next, the tape cartridge 100 will be described in detail with reference to FIGS. 2, 5, and 6. In describing the tape cartridge 100, referring to FIG. 2, the surface of the tape cartridge 100 located on the source side in the mounting direction, that is, its front surface, will be referred to as a "front surface," the opposite surface located on the destination side in the mounting direction will be referred to as a "back surface," the left side surface and the right side surface will be referred to as they read, the top, arc-shaped side surface will be referred to as a "tip surface," and the bottom side surface will be referred to as a "base surface."

As described above, the tape cartridge 100 is equipped with the cartridge case 130, the tape roll 106, the ribbon roll 114, the take-up core 116, and the platen roller 120 which are housed in it. The tape cartridge 100 also has the insertion opening 134 formed in the cartridge case 130, the tape sending outlet 138 which is formed in the left side surface near the platen roller 120, and an identification seal 141 (see FIG. 1) which is stuck to portions, adjacent to the tape roll 106, of the front surface, the left side surface, and the right side surface. A tape width, a tape color, a material, etc. of the print tape 102 that is housed in the cartridge case 130 are shown on two surfaces, that is, the front surface and the left side surface, of the identification seal 141.

The cartridge case 130 is an outer case of the tape cartridge 100 (shell structure), and has an L-shaped plan-view appearance in which a base portion of the right side surface projects a little. The cartridge case 130 is composed of a bottom case 150 and a top case 152 which are located on the destination side and the source side, respectively, in the front-to-back direction. In the cartridge case 130 employed in the embodiments, the top case 152 is a transparent resin mold and the bottom case 150 is an opaque resin mold. As described above, the plural kinds of tape cartridges 100 are prepared which are different from each other in thickness (i.e., the length in the mounting direction of the tape cartridge 100). Adjustments to the thickness differences between the tape cartridges 100A-100C are made using the bottom case 150 and the top case 152 is a common part.

A ceiling wall 156 having the front surface of the cartridge case 130 and a top circumferential wall 158 which goes down from the circumferential edge of the ceiling wall 156 are formed (molded) integrally with each other to form the top case 152. A bottom wall 160 having the back surface of the cartridge case 130, a bottom circumferential wall 162 which is erected from the circumferential edge of the bottom wall 160, and an opening circumferential wall 164 which is erected from the bottom wall 160 so as to define the above-mentioned insertion opening 134 are formed (molded) integrally with each other to form the bottom case 150.

Whereas the bottom end surface of the top circumferential wall 158 of the top case 152 is formed with plural joining pins 170 at proper intervals, and the bottom circumferential wall 162 of the bottom case 150 is formed with plural joining holes 172 at positions corresponding to the positions of the plural joining pins 170, respectively (see FIG. 5). The tape cartridge 100 is assembled by setting the components such as the tape roll 106 and the ribbon roll 114 in the bottom case 150 and then joining the top case 152 to the bottom case 150 so that the plural joining pins 170 are press-fit into the plural respective joining holes 172. To make the molding easier, the joining holes 172 are formed as through-holes.

Figure 6:
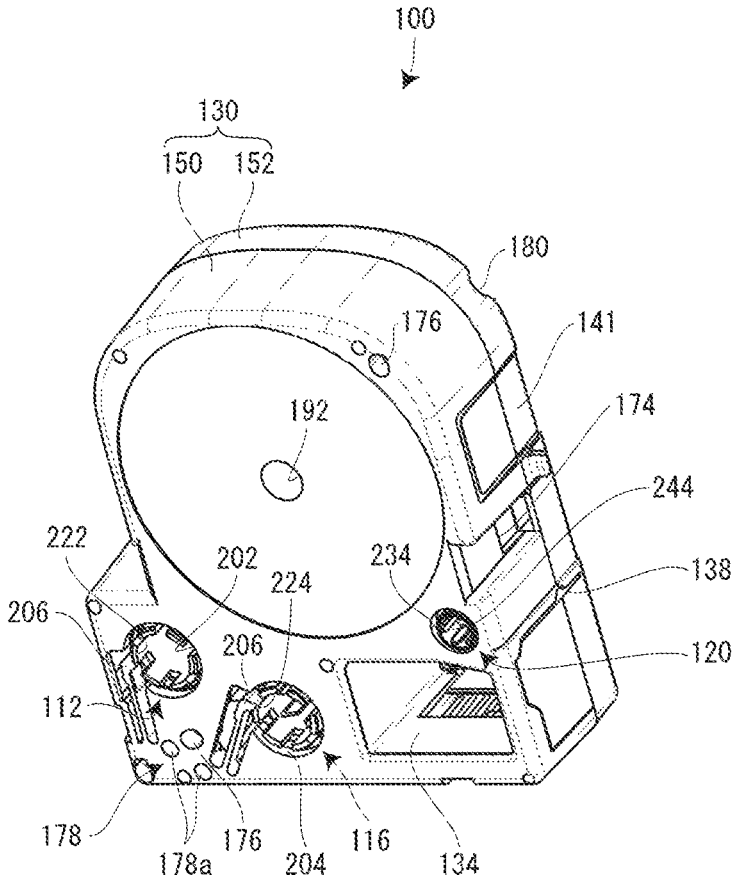
FIG. 6 is a perspective view, as viewed from the back surface side, of the tape cartridge.

On the other hand, the left side surface and the right side surfaces of the bottom case 150 are provided with a pair of latch receivers 174 to engage with the above-mentioned pair of latch pieces 57, respectively (see FIGS. 2 and 6). A rise of the tape cartridge 100 is prevented by engaging the latch pieces 57 of the cartridge mounting unit 5 with the pair of latch receivers 174 of the tape cartridge 100 mounted. The back surface of the bottom case 150 is formed with fitting small holes 176 to be fitted with the above-mentioned pair of small projections 55, respectively, with small margins (see FIG. 6). The pair of small projections 55 of the cartridge mounting unit 5 are fitted into the pair of fitting small holes 176 of the tape cartridge 100 mounted, whereby the tape cartridge 100 is positioned simply on the mounting base portion 31.

Furthermore, a base-surface-side left corner portion (a right corner portion when viewed from the front surface side) of the back surface of the bottom case 150 is formed with a detection receiving unit 178 which corresponds to the above-mentioned tape detection unit 51 (see FIG. 6). The detection receiving unit 178 is formed in portions corresponding to the plural microswitches 51*a* of the tape detection unit 51, and plural bit patterns are obtained depending on presence/absence of receiving holes 178*a* there. That is, the bit pattern corresponds to the type, excluding the above-mentioned tape width, of the print tape 102.

Figure 8A:
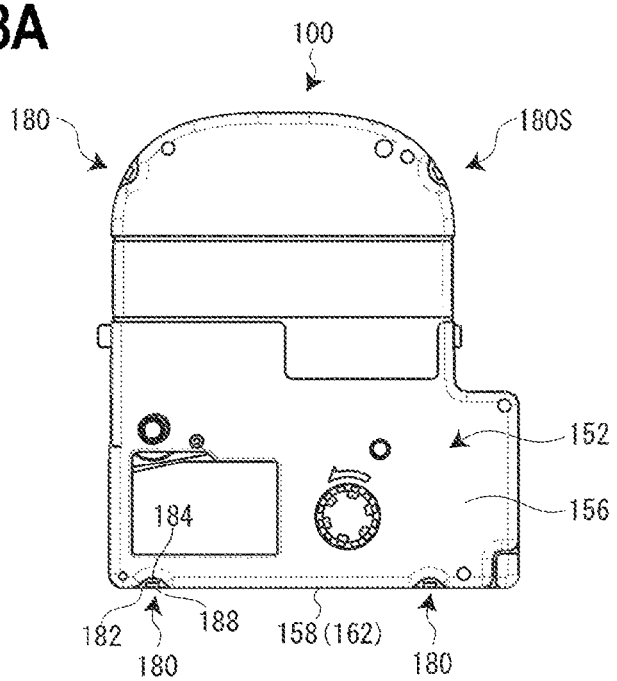
FIGS. 8A and 8B are a pan view and a sectional view, respectively, of the tape cartridge.
Figure 8B:
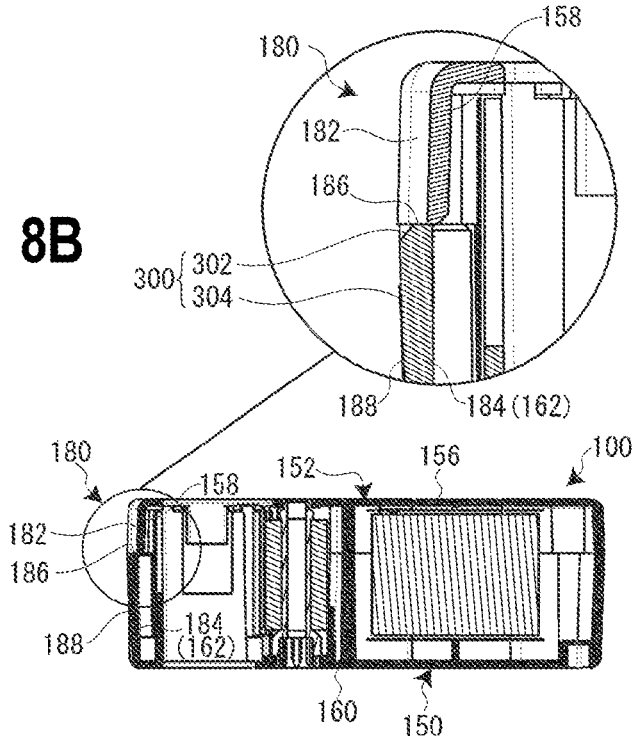

On the other hand, as shown in FIGS. 2, 5, and 8, the top circumferential wall 158 of the top case 152 are formed with recesses 182 at four positions in the circumferential direction. And the bottom circumferential wall 162 of the bottom case 150 is formed with thick portions 184 at four positions in the circumferential direction. End surfaces, on the top circumferential wall 158 side, of the respective thick portions 184 are butting surfaces against which portions of a disassembling jig (described later; not shown) are to butt.

Although not shown in any drawings, the disassembling jig has four posts which receive the above-mentioned four butting surfaces 186 of the tape cartridge 100 oriented upside down when the tape cartridge 100 used up is disassembled and four push-out pins which are inserted into the four respective joining holes 172 (through-holes) of the bottom case when the tape cartridge 100 is disassembled. The four push-out pins are lowered in a state that the tape cartridge 100 is set on the four posts, and they are inserted into the four respective joining holes 172 of the bottom case 150 from the back side of the bottom case 150. As a result, the four push-out pins push out the four respective joining pins 170 of the top case 152 simultaneously, whereby the bottom case 150 and the top case 152 are detached from each other.

As described above, the top case 152 is formed with the recesses 182 at the four positions and the bottom case 150 is formed with the thick portions 184 and their butting surfaces 186 at the four positions, as portions to be used for disassembling of the cartridge case 130. The recesses 182, the thick portions 184, and the butting surfaces 186 constitute detection target portions 180, corresponding to the above-mentioned thickness detection switches 65, of the tape cartridge 100, together with slide portions 188 which are formed in the outer surfaces of the respective thick portions 184. In the embodiment, three of the four detection target portions 180 correspond to the above-mentioned three detection switches 65 (described later in detail).

As shown in FIG. 5, a wide tape housing area 190 for housing the tape roll 106 is formed in an upper space (located on the tip surface side) of the cartridge case 130. The core shaft 192 which is formed (molded) integrally with the bottom case 150 is erected at the center of the tape housing area 190. The core shaft 192 is cylindrical, and the tape roll 106 (tape core 104) is supported pivotally (rotatably) by the outer circumferential surface of the core shaft 192. A tape guide 194 for guiding a paid-out portion of the print tape 102 to the platen roller 120 is erected from the bottom case 150 integrally with it near the platen roller 120 in the tape housing area 190.

That is, a tape feed passage 196 which extends from the tape roll 106 past the tape guide 194 and the platen roller 120 to the tape sending outlet 138 is formed inside the cartridge case 130. A portion, paid out from the tape roll 106, of the print tape 102 is guided to the platen roller 120 via the tape guide 194, subjected to printing there, and then guided from the platen roller 120 to the tape sending outlet 138.

The tape roll 106 has not only the print tape 102 and the tape core 104 but also two circular films 198 which are stuck to the two respective end surfaces of the roll-like print tape 102. The two circular films 198 prevent disintegration of the print tape 102 which is wound on the tape core 104. Although not shown in any drawings, the tape core 104 incorporates a reverse rotation preventive mechanism. When the tape cartridge 100 is carried, reverse rotation of the print tape 102 is prevented by the reverse rotation preventive mechanism. On the other hand, when the tape cartridge 100 is mounted in the cartridge mounting unit 5 of the tape printing apparatus 1, the reverse rotation prevention by the reverse rotation preventive mechanism is canceled by the above-mentioned positioning projection 41, whereby feeding of the print tape 102 is enabled.

A ribbon housing area 200 is formed adjacent to the insertion opening 134, that is, in a right-hand space of the base portion of the cartridge case 130. Pay-out-side bearings 202 for supporting the ribbon roll 114 (pay-out core 112) rotatably are formed at a right-hand position of the ribbon housing area 200 and take-up-side bearings 204 for supporting the take-up core 116 rotatably are formed at a left-hand position of the ribbon housing area 200, so as to be integral with the cartridge case 130. That is, each of the top case 152 and the bottom case 150 is formed with a pay-out-side bearing 202 and a take-up-side bearing 204.

Rotation stop hooks 206 are formed integrally in such a manner that tip portions of the rotation stop hooks 206 of the bottom case 150 are located in cuts of the pay-out-side bearing 202 and the take-up-side bearing 204, respectively. One rotation stop hook 206 is engaged with the pay-out core 112 so as to stop rotation of the pay-out core 112, and the other rotation stop hook 206 is engaged with the take-up core 116 so as to stop rotation of the take-up core 116.

A first ribbon guide 210 for guiding a paid-out portion of the ink ribbon 110 to the platen roller 120 is erected from the bottom case 150 integrally with it near the pay-out-side bearing 202 in the ribbon housing area 200. The outer circumferential surface of the above-mentioned opening circumferential wall 164 is formed with plural second ribbon guides 212 for guiding a portion, going around the opening circumferential wall 164, of the ink ribbon 110 in such a manner that the second ribbon guides 212 are integral with the opening circumferential wall 164.

That is, a ribbon feed passage 214 which extends from the ribbon roll 114 past the first ribbon guide 210, the platen roller 120, and the plural second ribbon guides 212 to the take-up core 116 is formed inside the cartridge case 130. A portion, paid out from the ribbon roll 114, of the ink ribbon 110 is guided to the platen roller 120 via the first ribbon guide 210, is subjected to printing there, then goes around the opening circumferential wall 164 (passes the plural second ribbon guides 212) starting from the platen roller 120, and is finally taken up by the take-up core 116.

Figure 5B:
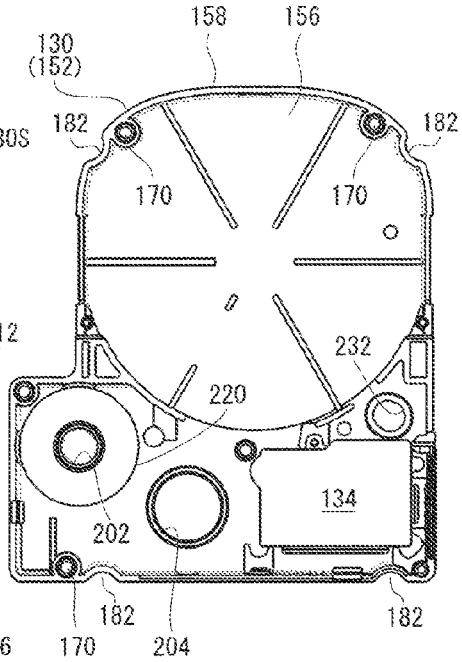

The ribbon roll 114 has not only the ink ribbon 110 and the pay-out core 112 but also a circular-ring-shaped leaf spring 220 for exerting a braking load on the pay-out core 112 (see FIG. 5B). The leaf spring 220 extends in a wavelike manner in the circumferential direction and is interposed between the ceiling wall 156 of the top case 152 and the pay-out core 112 in the axial direction. That is, a rotation braking load produced by the resilient force of the leaf spring 220 is exerted on the pay-out core 112. As a result, a portion, paid out by the take-up core 116, of the ink ribbon 110 is given back tension and thereby prevented from being loosened.

The pay-out core 112 is cylindrical and its end portion in the bottom case 150 is formed with plural cuts 222 in the circumferential direction (see FIG. 6). The above-mentioned rotation stop hook 206 engages with or disengages from the plural cuts 222. Whereas the bottom-case-150-side pay-out-side bearing 202 for supporting the pay-out core 112 has a circular opening, the top-case-152-side pay-out-side bearing 202 is a cylindrical projection. The above-mentioned leaf spring 220 is attached to this projection (see FIG. 5B).

Likewise, the take-up core 116 is cylindrical and its end portion in the bottom case 150 is formed with plural cuts 224 in the circumferential direction. The above-mentioned rotation stop hook 206 engages with or disengages from the plural cuts 224. The inner circumferential surface of the take-up core 116 is formed with spline grooves 226, and the take-up core 116 is spline-engaged with the above-mentioned take-up drive shaft 47. As a result, rotational power of the take-up drive shaft 47 is transmitted to the take-up core 116, whereby the ink ribbon 110 is taken up by the take-up core 116.

A platen housing area 230 is formed adjacent to the insertion opening 134, that is, in a left-hand space of the base portion of the cartridge case 130. A bottom bearing 234 having an elliptical opening (see FIG. 6) which is formed in the bottom case 150 and a top bearing 232 having an elliptical opening (see FIG. 5B) which is formed in the top case 152 are disposed at the center of the platen housing area 230. The platen roller 120 is supported by the top bearing 232 and the bottom bearing 234 so as to be rotatable and slightly movable in a horizontal direction. That is, the platen roller 120 which is supported by the top bearing 232 and the bottom bearing 234 which are elliptical is slightly movable in a horizontal direction between a home position where the platen roller 120 is to engage with the platen drive shaft 45 and a grip position where the platen roller 120 is in contact with the tape guide 194 to hold part of the print tape 102 between them.

Incidentally, the tape cartridge 100 is carried in a state that a very short paid-out end portion of the print tape 102 projects outward from the tape sending outlet 138 (see FIG. 1). If push-in force or pull-in force acts on the paid-out portion of the print tape 102 erroneously while the tape cartridge 100 is being carried, the platen roller 120 is moved to the above-mentioned grip position being dragged by the print tape 102. As a result, the paid-out end portion of the print tape 102 is prevented from being fully pulled into the cartridge case 130 through the tape sending outlet 138.

The platen roller 120 has a cylindrical roller base 240 and a rubber roller 242 which is attached to the outer circumferential surface of the roller base 240. The rubber roller 242 corresponds in axial length to the print head 21, and the print head 21 that has been moved to the printing position comes into contact with the rubber roller 242 with the print tape 102 and the ink ribbon 110 sandwiched between them. The inner circumferential surface of the roller base 240 is formed with spline grooves 244, and the roller base 240 is spline-engaged with the above-mentioned platen drive shaft 45. As a result, rotational power of the platen drive shaft 45 is transmitted to the platen roller 120, whereby the print tape 102 (and the ink ribbon 110) are fed for printing.

[Details of Detection Target Portions and Thickness Detection Switches]

Next, referring to FIGS. 3, 7, and 9, a detailed description will be made of the structure of the detection target portions 180 of the tape cartridge 100 according to the first embodiment together with the structure of the thickness detection switches 65 which are provided in the cartridge mounting unit 5. As described above, the mounting circumferential wall 33 of the cartridge mounting unit 5 is formed with the three thickness detection switches 65. And the outer circumferential surface of the tape cartridge 100 is formed with the detection target portions 180 at three positions in such a manner that they correspond to the respective thickness detection switches 65, as well as with a spare detection target portion 180S at one position.

Figure 7A:
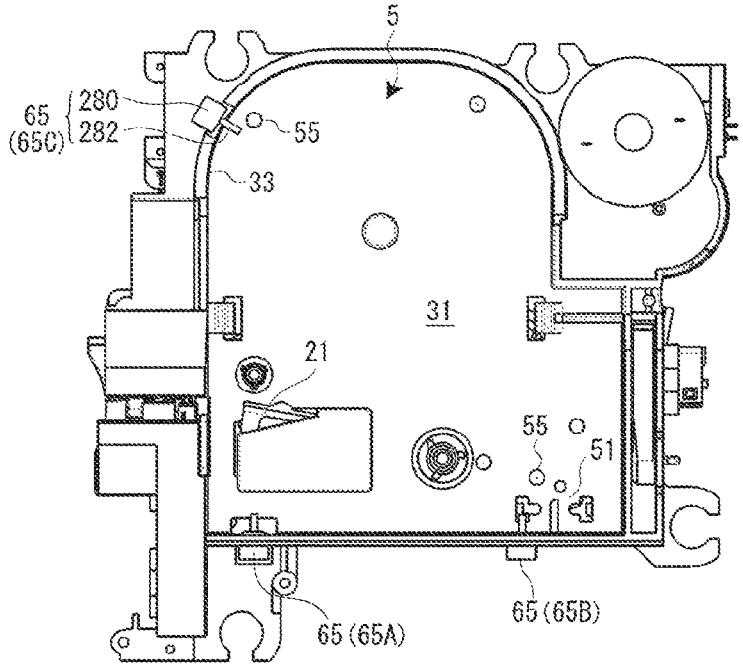
FIGS. 7A and 7B are a plan view and a perspective view, respectively, of a cartridge mounting unit.
Figure 7B:
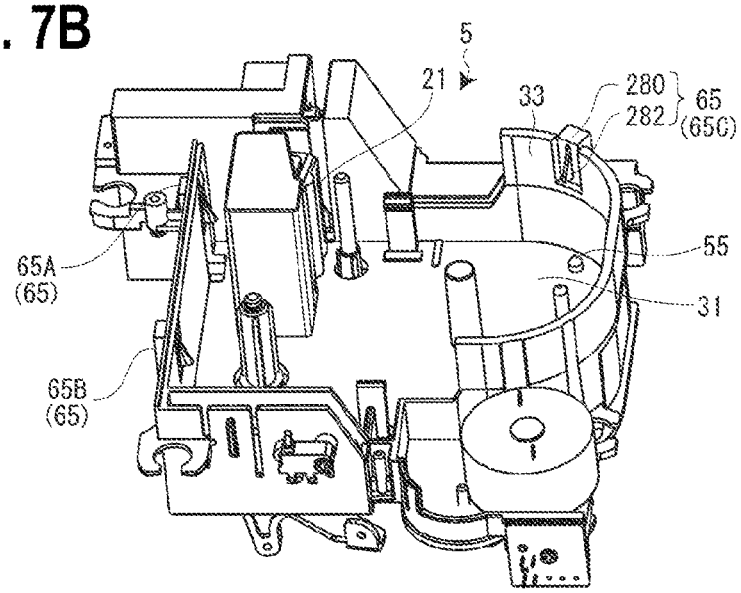
Figure 9A:
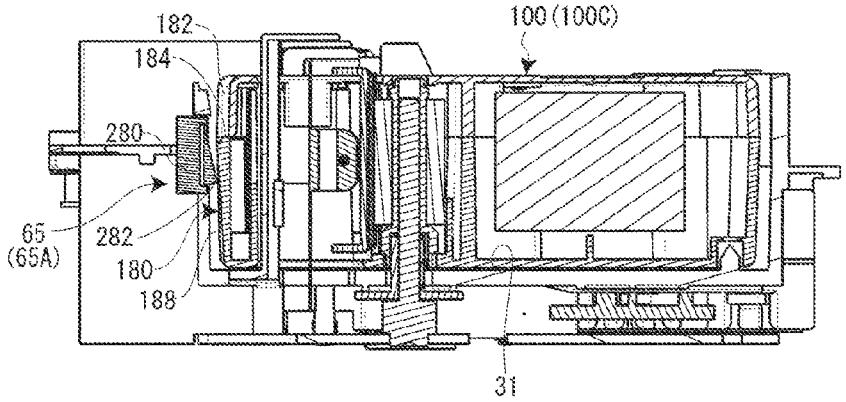
FIGS. 9A to 9C are enlarged sectional views of parts in a state that a thick tape cartridge is mounted in the cartridge mounting unit.
Figure 9B:
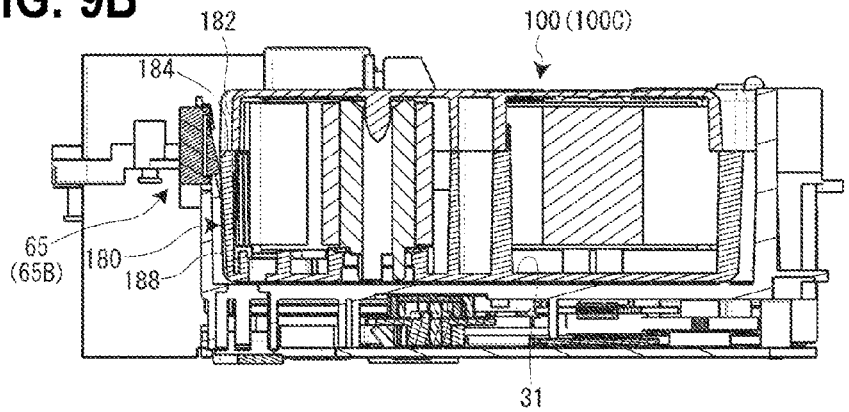
Figure 9C:
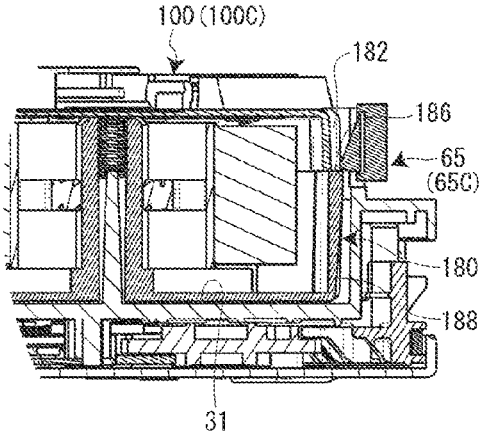

As shown in FIGS. 3, 7, and 9, the three thickness detection switches 65 the mounting circumferential wall 33 of the cartridge mounting unit 5 is formed with the three thickness detection switches 65 in such a manner that they are distributed in the circumferential direction. As described above, the first detection switches 65A, the second detection switch 65B, and the third detection switch 65C are disposed near the print head 21, the tape detection unit 51, and the one small projection 55, respectively. Here the first detection switches 65A, the second detection switch 65B, and the third detection switch 65C are provisionally referred to as a "12-mm-width switch," a "18-mm-width switch," and a "24-mm-width switch," respectively (see FIGS. 10A-10C; described later in detail).

Each thickness detection switch 65 has a switch main body 280 which is attached to the mounting circumferential wall 33 and a switch end (stem) 282 which is supported swingably by the switch main body 280 and serves to operate (turn on or off) the switch main body 280 by coming into direct contact with the tape cartridge 100 (cartridge case 130) (see FIGS. 7 and 9). The switch end 282 is urged by a built-in spring (not shown) in such a direction as to go away from the switch end 282. As for a method for using the thickness detection switch 65, the "on" state of the thickness detection switch 65 (switch main body 280) is defined as a state that the switch end 282 is swung (operated) in such a direction as to go away from the switch main body 280 by the spring force of the built-in spring. On the other hand, the "off state" of the thickness detection switch 65 (switch main body 280) is defined as a state that the switch end 282 is swung (operated) in such a direction as to come closer to the switch main body 280 against the spring force of the built-in spring.

That is, in a state that the switch end 282 is located in the recess 182 of the cartridge case 130, the switch end 282 is swung in such a direction as to go away from the switch main body 280 and hence the thickness detection switches 65 is on (in a first operation state). On the other hand, in a state that the tape cartridge 100 in a process of being mounted and the switch end 282 is in contact with the slide portion 188 which is formed in the outer circumferential surface of the cartridge case 130 and extends in the mounting/unmounting direction of the tape cartridge 100, the switch end 282 is swung in such a direction as to come closer to the switch main body 280 and hence the thickness detection switches 65 is off (in a second operation state). That is, the slide portion 188 is pushing the switch end 282 against the force of the built-in spring.

When the switch end 282 is moved from the slide portion 188 to the recess 182 as a relative movement, the switch main body 280 (thickness detection switch 65) is switched from off to on at an instant when it passes the butting surface 186. Likewise, when the switch end 282 slides on the slide portion 188 starting from the recess 182, the switch main body 280 (thickness detection switch 65) is switched from on to off at an instant when it passes the butting surface 186.

The first detection switch 65A (12-mm-width switch) is disposed so that when the thin tape cartridge 100A is mounted its switch end 282 goes into the recess 182 of the tape cartridge 100A and the first detection switch 65A is thereby turned on. More specifically, the first detection switch 65A is disposed at a low position in the cartridge mounting unit 5 (see FIGS. 9 and 10).

Likewise, the second detection switch 65B (18-mm-width switch) is disposed so that when the medium-thickness tape cartridge 100B is mounted its switch end 282 goes into the recess 182 of the tape cartridge 100B and the second detection switch 65B is thereby turned on. More specifically, the second detection switch 65B is disposed at a middle position in the cartridge mounting unit 5 (see FIGS. 9 and 10).

Likewise, the third detection switch 65C (24-mm-width switch) is disposed so that when the thick-thickness tape cartridge 100C is mounted its switch end 282 goes into the recess 182 of the tape cartridge 100C and the third detection switch 65C is thereby turned on. More specifically, the third detection switch 65C is disposed at a high position in the cartridge mounting unit 5 (see FIGS. 9 and 10).

As described in detail, when the thick-thickness tape cartridge 100C, for example, is mounted in the cartridge mounting unit 5, the first detection switch 65A is turned off, the second detection switch 65B is turned off, and the third detection switch 65C is turned on (see FIG. 9). The above-mentioned detection circuit which is connected to these three thickness detection switches 65 detects the thickness-related type of the tape cartridge 100 mounted according to whether the first detection switch 65A, the second detection switch 65B, and the third detection switch 65C are on or off (see FIG. 10C).

On the other hand, as shown in FIGS. 8 and 9, the outer circumferential surface of the tape cartridge 100 is formed with the detection target portions 180 at the three positions that correspond to the positions of the three thickness detection switches 65, respectively. As described above, each detection target portion 180 has the recess 182 which is recessed in the top circumferential wall 158 of the top case 152, the thick portion 185 which is formed in the bottom circumferential wall 162 of the bottom case 150 so as to correspond to the recess 182, the butting surface 186 which is the end surface, located on the side of the top circumferential wall 158, of the thick portion 184, and the slide portion 188 which is recessed in the outer surface of the thick portion 184.

The recess 182, which is a groove-shaped portion that turns on the thickness detection switch 65 opposed to it, is recessed inward so as to assume an arc shape in cross section. The recess 182 is formed so as to be continuous over the entire thickness of the top case 152 from the ceiling wall 156 and the top end of the top circumferential wall 157 to its bottom end. When located in the recess 182, the switch end 282 of the thickness detection switch 65 is swung in such a direction as to go away from the switch main body 280, whereby the thickness detection switch 65 is turned on (i.e., operated to signal detection).

The thick portion 184 is recessed so as to assume, in cross section, an arc shape that is similar to the arc shape of the recess 182. However, the arc shape (in cross section) of the thick portion 184 is one-size (i.e., by the thickness of the top circumferential wall 158) larger than that of the recess 182. The butting surface 186 which is the end surface, on the side of the recess 182 (top circumferential wall 158), of the thick portion 184 has the same sectional shape as the recess 182.

The slide portion 188 is a portion that turns off the thickness detection switch 65 opposed to it. In the embodiment, the slide portion 188 is a shallow-groove-shaped portion and is formed in the outer surface of the thick portion 184 so as to assume a U shape in cross section. The slide portion 188 is formed so as to be continuous over the entire thickness of the bottom case 150 from the top end to the bottom end of the bottom circumferential wall 162. Additionally, the groove shape of the slide portion 188 is shallowest near the top end and, in the embodiment, the slide portion 188 is formed so as to become deeper at a large angle as the position goes up and become deeper gradually as the position goes down.

That is, a contact surface 300, to which the switch end 282 of the thickness detection switch 65 is to come into contact, of the slide portion 188 has, above the above-mentioned position near the top end, a steep top guide surface (unmounting guide slant surface) 302 that forms an acute angle with the direction in which the tape cartridge 100 is unmounted. And the contact surface 300 has, below the above-mentioned position near the top end, a gentle bottom guide slant surface (mounting guide slant surface) 304 that forms an acute angle with the direction in which the tape cartridge 100 is mounted (see FIG. 8B). As a result, when the tape cartridge 100 is mounted or unmounted, the switch end 282 of the thickness detection switch 65 switches the thickness detection switch 65 smoothly without getting stuck in sliding on the slide portion 188 when being pushed.

The slide portion 188 need not always be in groove form.

Incidentally, as described above, the thickness differences between the plural kinds of tape cartridges 100 are compensated for by those between the bottom cases 150. That will be described below more specifically. In the tape cartridge 100 mounted, the height, as measured from the mounting base portion 31, of the butting surfaces 186 which are formed at the top of the bottom case 150 is fixed as an index indicating the thickness of the tape cartridge 100.

Therefore, when the thin tape cartridge 100A (12-mm-width cartridge) is mounted in the cartridge mounting unit 5, all of the first detection switch 65A (12-mm-width switch), the second detection switch 65B (18-mm-width switch), and the third detection switch 65C (24-mm-width switch) are turned on.

When the medium-thickness tape cartridge 100B (18-mm-width cartridge) is mounted, the first detection switch 65A (12-mm-width switch) is turned off and the second detection switch 65B (18-mm-width switch) and the third detection switch 65C (24-mm-width switch) are turned on.

When the thick tape cartridge 100C (24-mm-width cartridge) is mounted, the first detection switch 65A (12-mm-width switch) and the second detection switch 65B (18-mm-width switch) are turned off and the third detection switch 65C (24-mm-width switch) is turned on.

[Detection of Tape Cartridge Thickness]

FIGS. 10A to 10C show a method for detecting the thickness (type) of the tape cartridge 100. As shown in the figure, the distance from the mounting base portion 31 to the butting surfaces 186 (in the embodiment, the thickness of the bottom case 150) increases in order of the 12-mm-width cartridge, the 18-mm-width cartridge, and the 24-mm-width cartridge (see FIG. 10A). As for the positions of the thickness detection switches 65, the 12-mm-width switch is located at the recess 182 of the 12-mm-width cartridge, the 18-mm-width switch is located at the recess 182 of the 18-mm-width cartridge, and the 24-mm-width switch is located at the recess 182 of the 24-mm-width cartridge (see FIG. 10B).

The detection circuit judges that the tape cartridge 100 mounted is the 12-mm-width cartridge if all of the 12-mm-width switch, the 18-mm-width switch, and the 24-mm-width switch are on. That is, it is judged that the thin tape cartridge 100A is mounted if all of the first detection switch 65A, the second detection switch 65B, and the third detection switch 65C are on.

Likewise, the detection circuit judges that the tape cartridge 100 mounted is the 18-mm-width cartridge if the 12-mm-width switch is off and the 18-mm-width switch and the 24-mm-width switch are on. That is, it is judged that the medium-thickness tape cartridge 100B is mounted if the first detection switch 65A is off and the second detection switch 65B and the third detection switch 65C are on.

Likewise, the detection circuit judges that the tape cartridge 100 mounted is the 24-mm-width cartridge if the 12-mm-width switch and the 18-mm-width switch are off and the 24-mm-width switch is on. That is, it is judged that the thick tape cartridge 100C is mounted if the first detection switch 65A and the second detection switch 65B are off and the third detection switch 65C is on.

As described above, the detection circuit judges that the tape cartridge 100 mounted is the 12-mm-width cartridge if all of the 12-mm-width switch, the 18-mm-width switch, and the 24-mm-width switch are on. However, all of the detection switches are on even if no tape cartridge 100 is mounted; this state cannot be discriminated from the state that the 12-mm-width cartridge is mounted. This problem is solved by, for example, disposing a tape-cartridge-mounting-dedicated switch at such a position that it is opposed to the spare detection target portion 180S. Alternatively, the state that the 12-mm-width cartridge is mounted and the state that no tape cartridge 100 is mounted can be discriminated from each other by detecting state transitions that at first all the switches are on because no tape cartridge 100 is mounted, then the switches are turned off in a process of mounting because the slide portions 188 push the confronting thickness detection switches 65, and finally all the switches are turned on again.

As described above, in the tape cartridge 100 according to the embodiment, since the outer circumferential surface of the cartridge case 130 is formed with the three detection target portions 180 which correspond to the three respective thickness detection switches 65, size increase of the tape cartridge 100 can be suppressed even if the detection target portions 180 are provided. Furthermore, since the thickness of the tape cartridge 100 is detected utilizing the thickness of the bottom case 150, complication of the structure of the tape cartridge 100 can be suppressed even if the detection target portions 180 are provided. In addition, the detection target portions 180 can also serve as the portions to be used for disassembling of the tape cartridge 100. It goes without saying that the on/off settings of the thickness detection switch 65 may be reverse to the ones described above.

Since the spring forces of the thickness detection switches 65 act on the tape cartridge 100 from the sides, the holding effect of the spring forces of the three distributed thickness detection switches 65 can prevent positional deviation of the tape cartridge 100. In particular, the first detection switch 65A, the second detection switch 65B, and the third detection switch 65C are arranged so as to go away in this order from the platen roller 120 which receives pressing force from the print head 21. If it is assumed that the three kinds of tape cartridges 100 whose print tapes 102 have different widths are used at the same probability, by using the first detection switch 65A which is closest to the platen roller 120 as the 12-mm-width switch which is turned off at a highest probability (see FIG. 10C), the spring forces (urging forces) of the thickness detection switches 65 can be utilized efficiently for preventing positional deviation of the tape cartridge 100.

Although in the embodiment the three kinds of tape cartridges 100 which are different from each other in thickness are detected, a configuration may be employed in which more than three kinds of tape cartridges 100 are detected by increasing the number of thickness detection switches 65 and detection target portions 180. Furthermore, a push switch having a simple structure that the switch end 282 advances and retreats may be employed as each thickness detection switch 65.

The invention claimed is:

1. A tape cartridge to be mounted in a tape printing apparatus provided with a cartridge mounting unit which has a mounting base portion and a mounting circumferential wall surrounding the mounting base portion and in which plural kinds of tape cartridges different from each other in thickness in a mounting/unmounting direction can be mounted and plural push switches which project from the mounting circumferential wall at such positions that distances from the mounting base portion vary from each other according to thicknesses of the plural kinds of tape cartridges, the tape cartridge comprising:

plural detection target portions provided on an outer circumferential surface of the tape cartridge and to be opposed to an associated push switch of the plural push switches when the tape cartridge is mounted in or unmounted from the cartridge mounting unit, wherein each of the plural detection target portions has a slide portion that extends in the mounting/unmounting direction and operates the associated push switch while sliding when the tape cartridge is mounted in the cartridge mounting unit.

2. The tape cartridge according to claim 1, wherein the slide portion includes a mounting guide slant surface which guides the associated push switch when the tape cartridge is mounted in the cartridge mounting unit.

3. The tape cartridge according to claim 2, wherein the mounting guide slant surface forms an acute angle with the mounting direction of the mounting/unmounting direction.

4. The tape cartridge according to claim 1, wherein the slide portion includes an unmounting guide slant surface which guides the associated push switch when the tape cartridge is unmounted from the cartridge mounting unit.

5. The tape cartridge according to claim 4, wherein the unmounting guide slant surface forms an acute angle with the unmounting direction of the mounting/unmounting direction.

6. The tape cartridge according to claim 1, wherein the slide portion is recessed in the outer circumference surface.

7. The tape cartridge according to according to claim 1, wherein one of the detection target portions of the plural detection target portions that corresponds to a push switch of the plural push switches that is operated most frequently for the plural kinds of tape cartridges to be mounted is located at a position that is closest to a platen provided in the tape cartridge.

8. A tape cartridge to be mounted in a tape printing apparatus provided with a cartridge mounting unit which has a mounting base portion and a mounting circumferential wall surrounding the mounting base portion and in which plural kinds of tape cartridges different from each other in thickness in a mounting/unmounting direction can be mounted and plural push switches which project from the mounting circumferential wall at such positions that distances from the mounting base portion vary from each other according to thicknesses of the plural kinds of tape cartridges, the tape cartridge comprising:

a cartridge case that includes a top case and a bottom case; and plural detection target portions provided on an outer circumferential surface of the tape cartridge and to be opposed to an associated push switch of the plural push switches when the tape cartridge is mounted in or unmounted from the cartridge mounting unit, wherein each of the plural detection target portions has a slide portion that extends in the mounting/unmounting direction and operates the associated push switch while sliding when the tape cartridge is mounted in the cartridge mounting unit, and wherein the plural kinds of tape cartridges includes:

the top cases that are respectively located on a source side in the mounting direction of the mounting/unmounting direction and are the same in thickness; and the bottom cases that are respectively located on a destination side in the mounting direction of the mounting/unmounting direction and are different from each other in thickness, and at least one push switch of the plural push switches is not operated in a state that the tape cartridge is mounted in the cartridge mounting unit, and a recess to which the at least one push switch is to be opposed is formed in the top case.

9. The tape cartridge according to claim 8, wherein the top case and the bottom case are formed so as to be disassembled from each other in the mounting direction of the mounting/unmounting direction by a disassembling jig; and an end surface of a recess which extends from a source-side end in the mounting direction of the mounting/unmounting direction to a fixed position as an index indicating the thickness is a butting surface against which the disassembling jig is to butt.

10. The tape cartridge according to claim 8, wherein the plural detection target portions correspond to the plural push switches that are respectively disposed on the mounting circumferential wall so as to be distributed in a circumferential direction, and are disposed on the outer circumferential surface of the cartridge case so as to be distributed in the circumferential direction.

* * * * *